US005477437A

United States Patent [19]

Lach

[11] Patent Number: 5,477,437

[45] Date of Patent: Dec. 19, 1995

[54] ILLUMINATED FLAG

[76] Inventor: Robert L. Lach, 7215 Royal Green Dr., Cincinnati, Ohio 45244

[21] Appl. No.: 154,432

[22] Filed: Nov. 18, 1993

[51] Int. Cl.[6] ..... F21L 15/08

[52] U.S. Cl. ..... 362/252; 362/806; 362/103; 116/173

[58] Field of Search ..... 116/202, 173, 116/174; 362/800, 252, 806, 103, 108, 808, 251, 249, 105, 231, 234, 184

[56] References Cited

U.S. PATENT DOCUMENTS

| | | | |
|---|---|---|---|
| 2,280,817 | 4/1942 | Freeman | 116/173 X |
| 3,752,975 | 8/1973 | Meyer . | |
| 4,028,827 | 6/1977 | Hufton | 116/173 X |
| 4,110,818 | 8/1978 | Hempsey | 362/252 X |
| 4,308,572 | 12/1981 | Davidson et al. | 362/103 |
| 4,553,430 | 11/1985 | Behrens | 73/188 |
| 4,570,206 | 2/1986 | Deutsch | 362/103 |
| 4,884,524 | 12/1989 | Minotti | 116/173 X |
| 4,966,793 | 10/1990 | Covell | 362/252 X |
| 4,980,986 | 1/1991 | Harper | 43/17 |
| 5,024,406 | 6/1991 | Ketcham | 248/149 |
| 5,057,976 | 10/1991 | DeMong | 362/123 |
| 5,067,269 | 11/1991 | Eppey et al. | 43/17 |
| 5,104,608 | 4/1992 | Pickering | 362/32 |
| 5,113,325 | 5/1992 | Eisenbraun | 362/103 |
| 5,139,343 | 8/1992 | Lin | 362/226 |
| 5,150,963 | 9/1992 | Hill | 362/123 |
| 5,213,407 | 5/1993 | Eisenbraun | 362/123 |
| 5,366,780 | 11/1994 | Rapisarda | 362/103 X |

*Primary Examiner*—Ira S. Lazarus
*Assistant Examiner*—Thomas M. Sember
*Attorney, Agent, or Firm*—Wood, Herron & Evans

[57] ABSTRACT

A decorative flag includes openings between opposite sides thereof, a light string on the first side of the flag having lights mounted in the openings to extend to the second side of the flag and a cover removably secured to the first side of the flag to conceal the light string. The flag includes a sleeve along an upper edge thereof for mounting the flag to a flagpole so as to hang downwardly therefrom. The sleeve includes an opening or slot for extending an outlet end of the light string therein and along the flag pole, thereby to substantially conceal the outlet end of the light string. The flag bears an ornamental design and the lights accent or form part of the design. With the outlet end of the electrical light string plugged into an electrical outlet, or into an extension cord, the lights actuate to illuminate the second side of the flag and any design thereon. With one or more additional covers, lights may be extended outwardly from opposite directions to illuminate both sides of the flag.

14 Claims, 3 Drawing Sheets

ILLUMINATED FLAG

FIELD OF THE INVENTION

This invention relates to a unique decorative flag with improved visibility and increased usefulness.

BACKGROUND OF THE INVENTION

During the past few years, traditional flags have experienced a resurgence in popularity. Additionally, nontraditional decorative flags have also become increasingly popular.

One type of nontraditional decorative flag is trapezoidal in shape, with an angled upper edge having a sleeve sized to receive a flagpole oriented at the same angle as the upper edge. The flag hangs downwardly from the flagpole, supported by the sleeve. One problem with these and other flags is that spotlights must be used to see them when visibility is poor, i.e., at dawn, dusk, or even at night. Otherwise, without spotlights, the usefulness of the flag is limited.

While a flag illuminated by a spotlight creates an impressive sight, it is not always practical or convenient to mount one or more spotlights in position to illuminate the flag. This requires installation in a proper location and routing of electrical wires to that location. These impracticalities and inconveniences are especially true if a flagpole mounts directly to a wall of a house or porch, as is typical of many flags displayed from houses.

It is an objective of this invention to increase the visibility of a flag while at the same time eliminating the inconvenience associated with installing spotlights.

It is also an objective of this invention to enhance the aesthetic value of a flag in low visibility conditions, thereby increasing the usefulness of the flag.

SUMMARY OF THE INVENTION

The above-stated objectives are met by a flag with a concealably mounted electric light string located on a first side thereof, the lights from the string extending through openings to the second side of the flag, so that when an outlet end of the electric light string is plugged in, the lights illuminate the second side of the flag. Preferably, the lights form part of, or accent, a design on the second side of the flag. When the lights are illuminated, the design can be more readily seen when visibility is low, as at dawn, dusk or nighttime.

According to a preferred embodiment, the invention comprises a trapezoidal shaped flag designed to hang downwardly from an angled flagpole, an upper edge of the flag angled at the same angle as the flagpole. The flag has an integral sleeve along the upper edge which is sized to receive the flagpole, and the sleeve also has a centrally located cut or slot formed therein. The flag has grommets mounted thereon, and the grommets have internal openings. The light string is located on a first side of the flag, and lights of the light string mount through the grommet openings and extend to the second side.

A cover is removably secured to the first side of the flag to conceal the light string, with a lower edge of the cover sewn to the flag and the rest of the peripheral edge of the cover securable to the flag via velcro fasteners. An outlet end of the light string extends upwardly and out from between the cover and the flag, into the slot in the sleeve, so that the outlet end of the light string may be routed downwardly alongside the flagpole in a concealed manner within the sleeve.

If desired, lights may be used to illuminate both sides of the flag. This requires two covers, one on each side of the flag, and a longer light string, or two separate light strings. Some of the grommets are then used for lights which illuminate the first side of the flag, and other grommets are used for lights which illuminate the second side of the flag. With this embodiment, it is important to design the covers so that they do not conceal positions where lights will be extended.

As a further alternative to this embodiment, the flag itself could actually be two layers thick to accommodate two oppositely directed lights in each grommet opening, one for illuminating each side of the flag. This would allow the same design to be displayed on both sides of the flag.

The illuminated flag of this invention is easy to see when visibility is poor, and it does not require separate mounting of spotlights. Also, due to concealment of most of the light string, this illuminated flag represents an unobtrusive, aesthetically pleasing decorative item which can be used beyond daylight hours.

These and other features of the invention will be more readily understood in view of the following detailed description and drawings.

DETAILED DESCRIPTION OF THE PREFERRED EMBODIMENTS

Figure 1:
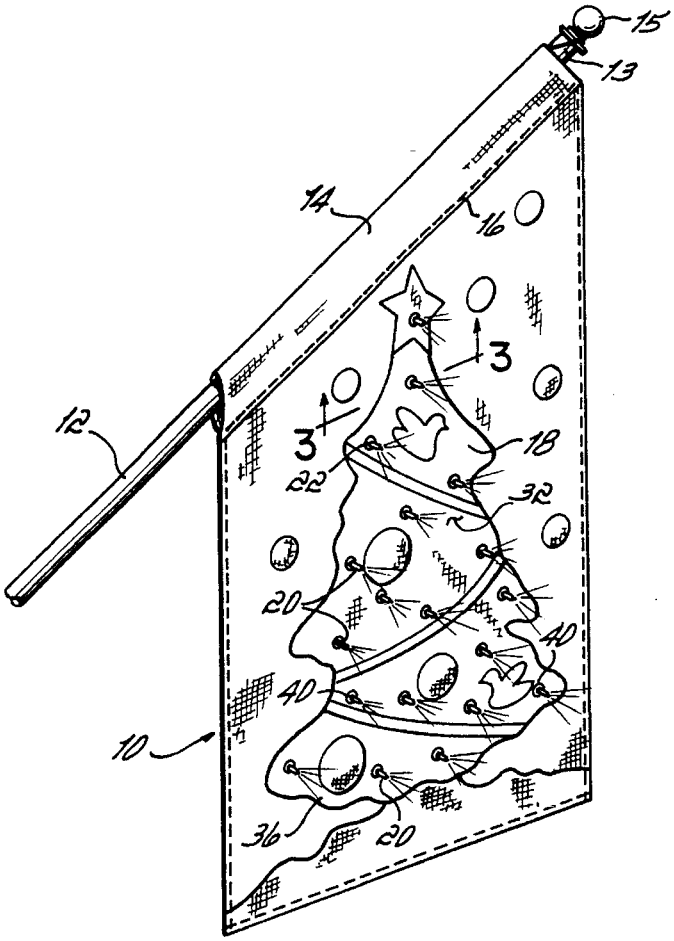
FIG. 1 is a front perspective view of an illuminated flag constructed in accordance with a first preferred embodiment of the invention.

FIG. 1 shows a flag 10 supported by a flagpole 12. The flag 10 is trapezoidal in shape, having a sleeve 14 extending along an angled upper edge thereof. While a trapezoidally shaped flag 10 is shown, other shapes would also be suitable. However, it is preferable that the shape provide an angled upper edge with a sleeve 14 oriented at the same angle as the flagpole 12 so that flag 10 may hang downwardly. Though not shown, the flag 10 may also include an additional loop or connector 13 to connect to the upper end 15 of the flagpole 12, thereby to prevent sliding. The flag 10 may be of any material typically used for making flags, though it is preferably made of a nonflammable material suitable for outdoor use.

FIG. 1 shows sleeve 14 integrally formed with the upper angled edge of the flag 10, as evidenced by sew line 16. However, if desired, the sleeve 14 may be formed as a separate component and then attached to the upper edge of the flag 10.

As shown in FIG. 1, the flag 10 bears a decorative design 18. This design includes a decorated Christmas tree and snowflakes. The design 18 born by the flag 10 may vary according to the particular season of use and the personal preferences and tastes of its owner.

The design 18 is illuminated during low visibility via lights 20 which extend through openings 22 in the flag 10. As shown more clearly in FIG. 2, the lights 20 are interconnected via an electrical light string 24, such as a typical Christmas light string. The light string 24 has an outlet end 26 terminating in an electrical plug 28 which is connectable into any standard electrical outlet or extension cord.

Figure 2:
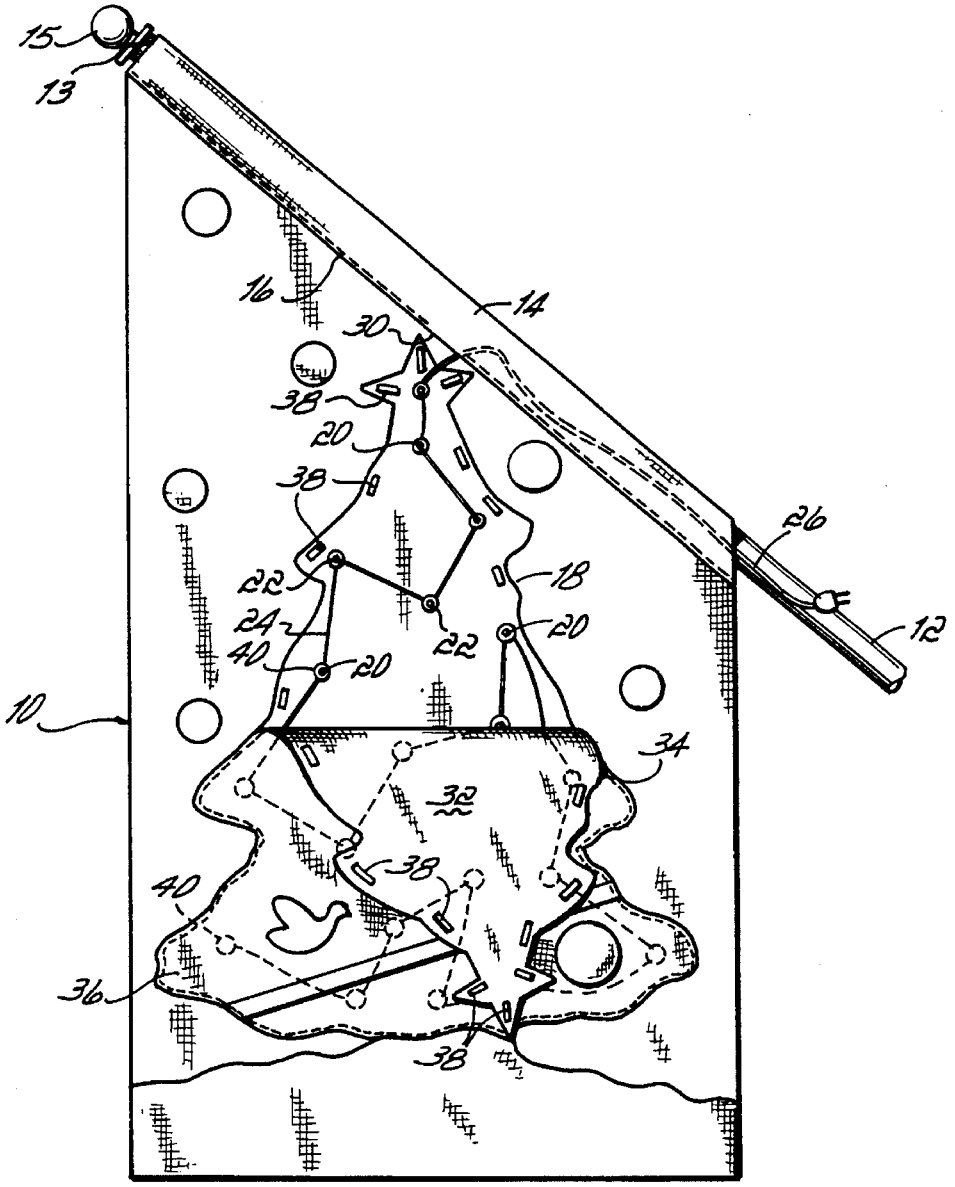
FIG. 2 is a rear view of the illuminated flag shown in FIG. 1.

Preferably, as shown in FIG. 2, the outlet end 26 of the light string 24 extends outwardly from the design 18 near the top of flag 10 and through a slot 30 formed in the sleeve 14. This slot 30 may be formed by leaving a space in the sew line 16. The slot 30 allows the outlet end 26 to be routed downwardly alongside the flagpole 12 while concealed within the sleeve 14. This provides a simple and unobtrusive manner for electrically connecting the lights 20. Alternatively, the outlet end 26 could actually be routed within the flagpole 12, though this would be more costly in fabrication. Also, since the lights 20 are most effective when visibility is low, as at dawn, dusk or nighttime, those portions of the outlet end 26 and the plug 28 which are outside of the sleeve 14 are not so noticeable as to present a problem.

To conceal the light string 24, a cover 32 removably secures to the first or rear side of the flag 10. The cover 32 may be made of any nonflammable material suitable for outdoor use, and may be made of the same material as the flag 10. As shown in FIG. 2, the cover 32 has a peripheral edge 34 or outline which is identical to that of design 18. Preferably, a bottom portion 36 of the peripheral edge 34 is sewn to the flag 10 and the rest of the peripheral edge 34 of the cover 32 connects to the flag 10 via velcro fasteners 38. This enables cover 32 to be peeled away from the flag 10 for extension of the lights 20 through the openings 22, and then readily located back in place to conceal the lights 20 and the light string 24. If desired, other fastening elements may be used, such as hooks, buttons, etc., so long as the cover may be secured and unsecured to the flag 10 in a relatively quick and simple manner.

Figure 3:
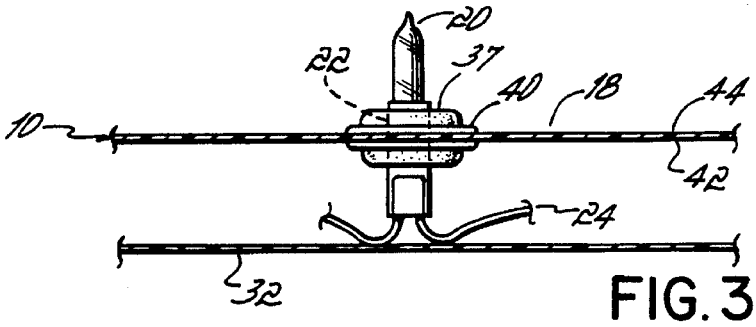
FIG. 3 is a cross-sectional view taken along lines 3—3 of FIG. 1.

FIG. 3 shows an electrical light 20 of the light string 24 mounted within an opening 22 in the flag 10. The light 20 is mounted within a rubber grommet 37 which is anchored inside a metal grommet 40 secured to the flag 10. Preferably, the outside diameter of the light 20 substantially matches the inside diameter of the rubber grommet 37 to hold the light 20 securely in place. As shown in FIG. 3, the light string 24 is located between the flag 10 and cover 32, or on a first side 42 of the flag 10. The light 20 illuminates a second side 44 of the flag 10.

Figure 4:
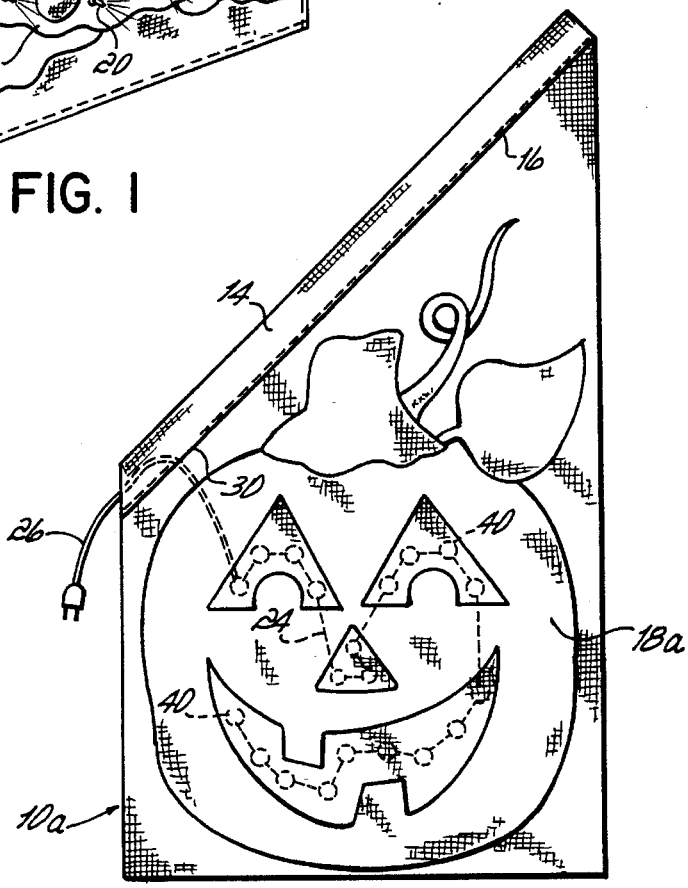
FIG. 4 is a front view of an illuminated flag constructed in accordance with the invention, similar to FIG. 1, but showing a different design on the flag.

FIG. 4 shows a flag **10*a* which is similar to flag 10 of FIGS. 1–3, but with a different design, designated by reference numeral 18*a*. This illustrates the applicability of this invention to flag designs representative of various seasons of the year. The configuration and/or shape of the design will most likely dictate the location of the slot 30 in sleeve 14 for routing the outlet end 26 of the light string 24. The shape also plays some role in dictating the locations for mounting the lights 20**.

In use, the flag 10 is mounted to a flagpole 12 by sliding the sleeve 14 thereover. With the cover 32 pulled back from the first side 42 of the flag 10, the lights 20 of the light string 24 are then positioned within the openings 22 defined by the grommets 37. The light string 24 is oriented such that the outlet end 26 extends through a slot 30 in the sleeve 14 and downwardly along the flagpole 12 within the sleeve 14. By securing the cover 32 to the flag 10, as by the velcro fasteners 38, the light string 24 is concealed. By plugging the electrical plug 28 into an electrical outlet or the outlet of an extension cord, the lights 20 actuate to illuminate the second side 44 of the flag 10.

Figure 5:
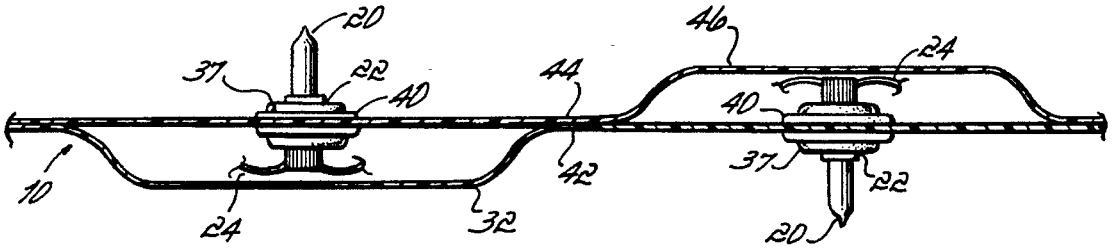
FIG. 5 is a cross-sectional view, similar to FIG. 3, showing a second preferred embodiment of the invention.

The invention further contemplates the use of lights 20 for illuminating the first side 42 and the second side 44 of a flag 10. According to one manner of accomplishing this objective, some of the openings 22 must be designated for use by lights 24 illuminating the first side 42, and some of the openings 22 must be designated for use by lights 20 which illuminate the second side 44 (FIG. 5). An additional cover 46 is required for covering the light string on the second side 44 of the flag 10. With two covers, i.e., first cover 32 and a second cover 46, the covers must be laterally spaced from each other and/or shaped so as not to conceal any of the lights 20. Alternatively, the covers so may include openings for permitting extension therethrough of the lights 20.

Figure 6:
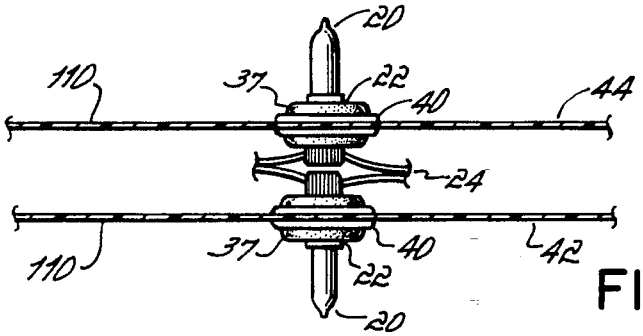
FIG. 6 is a cross-sectional view, similar to FIGS. 3 and 5, showing a third preferred embodiment of the invention.

According to still another embodiment of the invention, particularly one wherein an identical design is desired on both sides of the flag 10, two oppositely directed lights 20 may be mounted in each opening 22, with the lights illuminating opposite sides of the flag 10. To accomplish this objective, the flag itself may comprise two layers, as designated by reference numerals 110 in FIG. 6. These layers 110 may be equal in dimension, providing a double layered flag throughout the entire length and width, with a pocket between the layers 110.

A plurality of grommets 40 could then be used to secure the two flag layers 110 together and define openings for mounting two oppositely directed lights 20 so as to illuminate the first side 42 and the second side 44 of the flag. In this manner, the lights 20 may be part of the same light string 24 or separate light strings 24.

For these additional embodiments, the invention is mounted to a flagpole 12 and the light string 24 is electrically connected in the same manner as described with respect to FIGS. 1–4, the only difference being the illumination of both sides of the flag 10. While three preferred embodiments of the invention have been described, one of ordinary skill in the art will appreciate that modifications may be made without departing from the scope of the invention. Therefore, applicant desires to be limited only by the scope of the following claims and equivalents thereof.

I claim:

1. The combination, comprising:

a flagpole angled upwardly at an acute angle with respect to horizontal and vertical orientations;

a flag supported by the flagpole and hanging substantially downwardly therefrom, the flag having first and second sides and a plurality of openings between the first and second sides;

a first flexible light string located on the first side of the flag, the light string having a plurality of electrically energizable lights interconnected via an electrically conductive element, the lights extending through the openings to the second side of the flag;

a first cover removably secured to the flag along the first side to conceal the light string;

means for electrically energizing the light string via the electrically conductive element to actuate the lights and illuminate the second side of the flag; and a sleeve located along an upper edge of the flag and surrounding the flagpole to support the flag thereon, the sleeve having a slot formed therein; and the light string having an outlet end extending outwardly from between the flag and the first cover, through the slot and downwardly through the sleeve alongside the flagpole, thereby to minimize noticeability of the light string.

2. The combination, comprising:

a flagpole;

a flag supported by the flagpole, the flag having first and second sides and a plurality of openings between the first and second sides;

a first light string located on the first side of the flag, the light string having a plurality of lights mounted thereon, the lights extending through the openings to the second side of the flag;

a first cover removably secured to the flag along the first side to conceal the light string; and means for electrically energizing the light string to actuate the lights and illuminate the second side of the flag, wherein the cover has a peripheral edge and a portion of the peripheral edge is sewn to the flag, the cover removably secured to the first side of the flag along the rest of the peripheral edge via fastening means.

3. The invention of claim 2 wherein the fastening means comprises velcro fasteners.

4. The decorative item comprising:

a first cloth member having first and second sides;

a second cloth member removably secured to the first side of the first cloth member;

the first cloth member having a plurality of openings;

a first light string substantially concealed between the first and second cloth members, the light string having a plurality of lights projecting through the openings to the second side; and means for electrically engerizing the light string to actuate the lights and illuminate the second side of the flag, wherein the second cloth has a peripheral edge and the second cloth is secured to the first cloth along the peripheral edge, a portion of the peripheral edge being sewn to the first cloth and the rest of the peripheral edge being removably secured to the first cloth via fastening means.

5. The decorative item of claim 4 wherein the first cloth has an angled upper edge adapted to be secured to an angled flagpole.

6. The decorative item of claim 5 wherein the first cloth is trapezoidal in shape.

7. The decorative item of claim 5 wherein the upper edge includes a sleeve adapted to surround a flagpole to support the flag thereon.

8. The decorative item of claim 7 wherein the sleeve is integral with the first cloth.

9. The decorative item of claim 4 wherein the sleeve includes a slot, the light string having an outlet end extended into the slot and downwardly within the sleeve and along the flagpole, thereby to substantially conceal the outlet end of the light string.

10. The decorative item of claim 4 and further comprising:

a plurality of grommets mounted to the first cloth member and defining the locations of the openings, the grommets sized to receivably retain the lights.

11. A decorative item comprising:

a first cloth member having first and second sides;

a second cloth member removably secured to the first side of the first cloth member;

the first cloth member having a plurality of openings;

a first light string substantially concealed between the first and second cloth members, the light string having a plurality of lights projecting through some of the openings to the second side;

means for electrically energizing the light string to actuate the lights and illuminate the second side of the flag;

a third cloth member removably secured to the second side of the first cloth member;

a second light string substantially concealed between the first and third cloth members, the second light string having lights projecting through others of the openings to the second side of the flag; and means for electrically energizing the second light string to illuminate the first side of the flag, wherein the second and third cloth members are shaped so as to not conceal any of the lights from the second and first light strings, respectively.

12. A decorative item comprising:

a flag having double layers, at least one of the layers having a peripheral edge and being removably secured to the other of the layers along a portion of the removable edge, first and second exterior sides and a pocket between the double layers, the flag further having a plurality of openings extending between the first and second exterior sides;

at least one flexible light string residing within the pocket between the layers of the flag so as to be substantially concealed between the double layers of the flag, the light string including a plurality of electrically energizable lights interconnected via an electrically conductive element, some of the lights extending outwardly through some of the openings to the first exterior side of the flag and some of the lights extending outwardly through some of the openings to the second exterior side of the flag; and means for supplying electrical energy to the lights of the light string via the electrically conductive element to electrically actuate the lights, thereby to illuminate the first and second exterior sides of the flag.

13. The decorative items of claim 12 wherein a pair of oppositely directed lights are mounted in each opening.

14. The decorative items of claims 12 wherein the layers are equal in dimension.

* * * * *